US007939997B2

(12) United States Patent
Yamazaki

(10) Patent No.: US 7,939,997 B2
(45) Date of Patent: May 10, 2011

(54) IMAGE DISPLAYING APPARATUS

(75) Inventor: Koji Yamazaki, Ayase (JP)

(73) Assignee: Canon Kabushiki Kaisha, Tokyo (JP)

( * ) Notice: Subject to any disclaimer, the term of this patent is extended or adjusted under 35 U.S.C. 154(b) by 144 days.

(21) Appl. No.: 12/482,844

(22) Filed: Jun. 11, 2009

(65) Prior Publication Data

US 2010/0001630 A1 Jan. 7, 2010

(30) Foreign Application Priority Data

Jul. 4, 2008 (JP) ..... 2008-175677

(51) Int. Cl.

| | |
|---|---|
| ***H01J 1/00*** | (2006.01) |
| ***H01J 1/36*** | (2006.01) |
| ***H01J 1/62*** | (2006.01) |
| ***H01J 19/32*** | (2006.01) |

(52) U.S. Cl. ..... 313/497; 313/495; 313/496

(58) Field of Classification Search ..... 313/495–497
See application file for complete search history.

(56) References Cited

U.S. PATENT DOCUMENTS

| | | | | |
|---|---|---|---|---|
| 6,509,691 | B2 | 1/2003 | Yamazaki et al. | 315/169.3 |
| 6,815,885 | B1 * | 11/2004 | Bancal et al. | 313/496 |
| 6,853,148 | B2 | 2/2005 | Yamazaki et al. | 315/169.3 |
| 6,927,533 | B1 | 8/2005 | Ito et al. | 313/495 |
| 7,053,537 | B2 | 5/2006 | Hiroike et al. | 313/292 |
| 7,161,288 | B2 * | 1/2007 | Takenaka et al. | 313/496 |
| 7,247,981 | B2 | 7/2007 | Yamazaki | 313/497 |
| 7,391,149 | B2 | 6/2008 | Yamazaki | 313/495 |
| 7,400,082 | B2 | 7/2008 | Suzuki et al. | 313/473 |
| 7,537,503 | B2 | 5/2009 | Hiroike et al. | 445/24 |
| 7,541,731 | B2 * | 6/2009 | Sata et al. | 313/496 |
| 7,626,325 | B2 * | 12/2009 | Murata et al. | 313/496 |
| 2004/0195958 | A1 * | 10/2004 | Ito et al. | 313/496 |
| 2005/0082963 | A1 | 4/2005 | Miyazaki et al. | 313/493 |
| 2006/0061258 | A1 | 3/2006 | Tagawa et al. | 313/496 |
| 2006/0284545 | A1 * | 12/2006 | Haraguchi | 313/496 |

(Continued)

FOREIGN PATENT DOCUMENTS

| | | |
|---|---|---|
| EP | 1 172 836 A1 | 1/2002 |

(Continued)

OTHER PUBLICATIONS

European Search Report issued in the counterpart application No. 09163656.3 dated July 1, 2010—11 pages.

*Primary Examiner* — Mariceli Santiago
(74) *Attorney, Agent, or Firm* — Fitzpatrick, Cella, Harper & Scinto

(57) ABSTRACT

To simultaneously suppress halation and discharging current flowing in the unlikely event of discharge, and easily perform potential regulating for a spacer, an image displaying apparatus comprises: a rear plate having electron-emitting devices arranged in matrix; a face plate having a substrate, light-emitting members arranged in matrix on the substrate, metal backs each covering at least one member and mutually arranged in matrix at gaps, ribs having first striped portions respectively positioned among the members and protruding toward the rear plate, and a resistive wiring including a resistor between the substrate and the ribs and electrically connecting the metal backs, and positioned oppositely to the rear plate; and a spacer positioned between the rear plate and the ribs to mutually support the rear and face plates, wherein the rib has a spacer connection wiring abutting against the spacer, and the spacer connection wiring is electrically connected to the resistive wiring.

7 Claims, 5 Drawing Sheets

U.S. PATENT DOCUMENTS

| | | | | |
|---|---|---|---|---|
| 2007/0164674 | A1 | 7/2007 | Hori | 313/512 |
| 2007/0236150 | A1 | 10/2007 | Hayashida | |
| 2009/0160313 | A1 | 6/2009 | Yamazaki et al. | 313/495 |

FOREIGN PATENT DOCUMENTS

| | | | | |
|---|---|---|---|---|
| EP | 1 624 476 | A1 | | 2/2006 |
| EP | 1 638 129 | A2 | | 3/2006 |
| JP | 2006092963 | A | * | 4/2006 |
| JP | 2006-120622 | A | | 5/2006 |
| JP | 2006-126260 | A | | 5/2006 |
| WO | WO 94/18694 | | | 8/1994 |

* cited by examiner

IMAGE DISPLAYING APPARATUS

BACKGROUND OF THE INVENTION

1. Field of the Invention

The present invention relates to an image displaying apparatus, and, more specifically to a constitution of a face plate.

2. Description of the Related Art

Conventionally, an image displaying apparatus which comprises a rear plate having plural electron-emitting devices arranged two-dimensionally and a face plate having plural light-emitting members arranged two dimensionally and oppositely to the plural electron-emitting devices has been known. In the image displaying apparatus like this, the face plate and the rear plate are mutually supported generally by a spacer so as to be opposite to each other at a gap of about several millimeters. Moreover, high voltage of, e.g., approximately 10 kV is applied between the face plate and the rear plate. Consequently, a discharge occurs easily between the face plate and the rear plate, and, if the discharge once occurs, a discharging current flows into the whole of a metal back which has been united overall, whereby an influence to the electron-emitting devices expands.

Consequently, in order to allow the image displaying apparatus of the above type to have a discharging current suppressing function, Japanese Patent Application Laid-Open No. 2006-120622 (corresponding to U.S. Patent Application Publication No. US2006/0061258) discloses a technique for suppressing a discharging current flowing in the unlikely event of a discharge by two-dimensionally divided metal backs and striped resistors. Here, each column of the striped resistors is connected only to corresponding each column of the divided metal backs. Therefore, even if a discharge occurs on a certain column, it is possible to restrain the discharging current from flowing into another column.

On the other hand, in regard to a flat display, there is a problem that a displayed image becomes unclear due to halation.

Further, Japanese Patent Application Laid-Open No. 2006-126260 (corresponding to U.S. Patent Application Publication No. US2007/0236150) discloses a technique for restraining halation from occurring by forming a supporting member made of an insulative material on the surface of a face plate and further forming an intermediate electrode on the formed supporting member. In this case, since potential which is slightly higher than that of an anode electrode applied onto the surface of the face plate is applied to the intermediate electrode, the electrons reflected on the surface of the face plate can be captured. Thus, it is possible to prevent that the reflected electrons reenter the light-emitting members (phosphors) on the face plate. Moreover, Japanese Patent Application Laid-Open No. 2006-126260 discloses a technique for providing the intermediate electrode between the face plate and the rear plate.

SUMMARY OF THE INVENTION

The present invention has been completed in consideration of the above-described related art, and aims to provide an image displaying apparatus which simultaneously suppresses both halation and a discharging current flowing in the unlikely event of a discharge, and in which potential regulating for a spacer can be easily performed.

An image displaying apparatus according to one embodiment of the present invention is characterized by comprising: a rear plate that has plural electron-emitting devices arranged in matrix; a face plate that has a substrate, plural light-emitting members arranged in matrix on the substrate, plural metal backs each of which covers at least the one light-emitting member and which are mutually arranged in matrix at gaps, ribs which have first striped portions respectively positioned among the plural light-emitting members and protruding toward the rear plate, and a resistive wiring which includes a resistor positioned between the substrate and the ribs and electrically connecting the plural metal backs to others, and that is positioned oppositely to the rear plate; and a spacer that is positioned between the rear plate and the ribs to mutually support the rear plate and the face plate, wherein the rib has, on its surface, a spacer connection wiring which abuts against the spacer, and wherein the spacer connection wiring is electrically connected to the resistive wiring.

In the image displaying apparatus according to the present invention, the metal backs are arranged two-dimensionally, and each of the metal backs covers at least one light-emitting member. In other words, since the metal backs are divided two-dimensionally, it is possible to easily suppress a discharging current flowing in the unlikely event of a discharge. Further, since the metal backs cover the light-emitting members and the ribs having the first striped portions extend among the light-emitting members, it is possible to provide the plural ribs as preventing interference with the light-emitting members. Consequently, since halation can be suppressed, it is possible to provide the image displaying apparatus of which the color reproducibility is excellent. Moreover, since the spacer connection wiring which extends from the resistive wiring to the top surface of the rib is provided on the side wall of the rib, it is unnecessary to provide an independent wiring to be used for the purpose of potential regulating for the spacer. Consequently, it is possible to perform the potential regulating for the spacer by the simple-constitution spacer connecting wiring.

As described above, according to the present invention, it is possible to provide the image displaying apparatus which simultaneously suppresses both the halation and the discharging current flowing in the unlikely event of the discharge, and in which the potential regulating for the spacer can be easily performed.

Further features of the present invention will become apparent from the following description of the exemplary embodiments with reference to the attached drawings.

DESCRIPTION OF THE EMBODIMENTS

Hereinafter, the exemplary embodiments of the present invention will be described with reference to the attached drawings. Here, it should be noted that an image displaying apparatus according to the present invention is applicable to an electron beam displaying apparatus such as a CRT (Cathode Ray Tube), an FED (Field Emission Display) or the like. In particular, since a beam diameter can be easily narrowed down, color reproducibility can be significantly improved by suppressing halation. Moreover, since a space between an anode and a cathode becomes a state of high electrical field in the FED, a withstand discharge capability is required. Therefore, the FED is a preferable conformation to which the present invention is applied.

As to the embodiments of the present invention, it will be specifically described with reference to the drawings by exemplifying an image displaying apparatus of using surface conduction electron-emitting devices (SED (Surface-Conduction Electron-emitter Display) in particular among the FEDs.

First Embodiment

Figure 1:
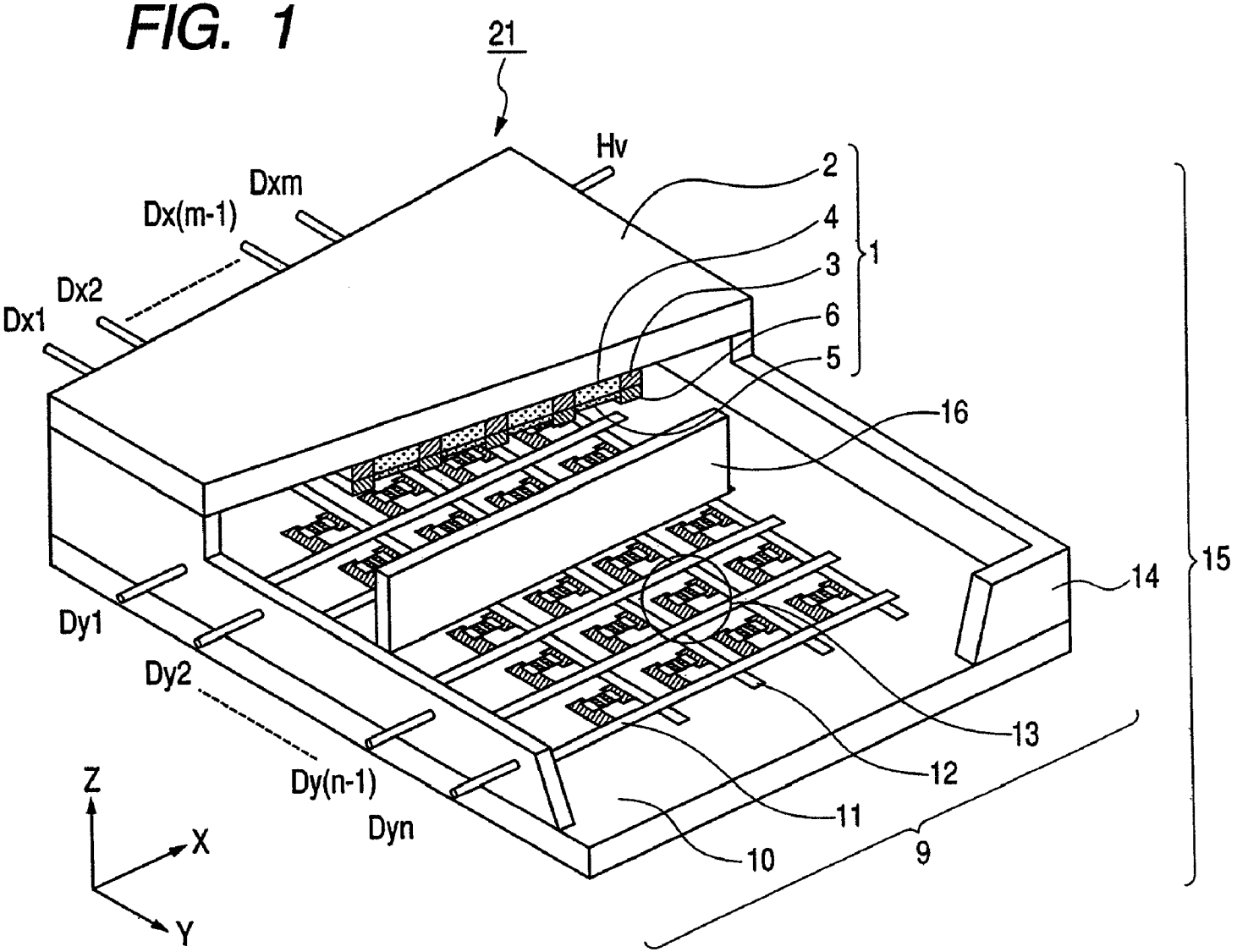
FIG. 1 is a partial fractured perspective diagram illustrating a basic constitution of an image displaying apparatus according to an embodiment of the present invention.

FIG. 1 is a partial fractured perspective diagram illustrating a basic structure of an image displaying apparatus according to the embodiment of the present invention. An image displaying apparatus 21 has a rear plate 9, which has two-dimensionally arranged plural surface conduction electron-emitting devices 13, and a face plate 1, which is arranged oppositely to the rear plate 9. The face plate 1 and the rear plate 9 form a vacuum envelope 15 together with an outer frame 14. A spacer 16, which is positioned between the rear plate 9 and the face plate 1 and mutually supports the rear plate 9 and the face plate 1, is provided inside the vacuum envelope 15. The space 16 is made by a high resistive member through which a small amount of current can be flowed for an antistatic purpose. In any case, the image displaying apparatus 21 is constituted by further adding a power supply, a driver circuit and the like, which are not illustrated, to the vacuum envelope 15.

The rear plate 9 has a glass substrate 10, scanning wirings 11 and signal wirings 12 respectively formed on the glass substrate 10, and the surface conduction electron-emitting devices 13 also formed on the glass substrate 10. The number of the scanning wirings 11 is N and the number of the signal wirings 12 is M, and the N×M surface conduction electron-emitting devices 13 are formed in matrix. Here, the numbers N and M, which are positive integers, can be arbitrarily set in accordance with the intended number of display pixels. For example, in case of forming an FHD (Full High Definition) panel, the number N is equal to 1080 and the number M is equal to 1920×3=5760.

Figure 2A:
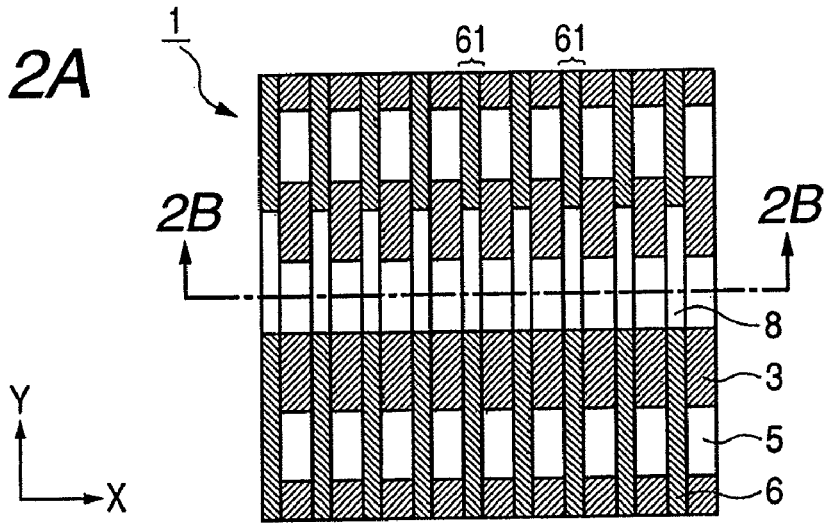
FIGS. 2A, 2B and 2C are detailed diagrams illustrating a face plate of the image displaying apparatus illustrated in FIG. 1.
Figure 2B:
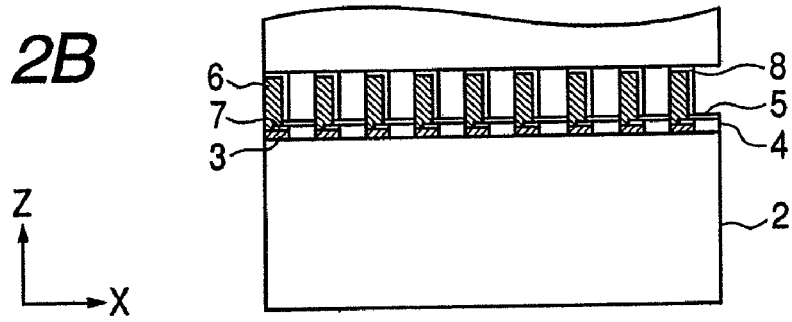
Figure 2C:
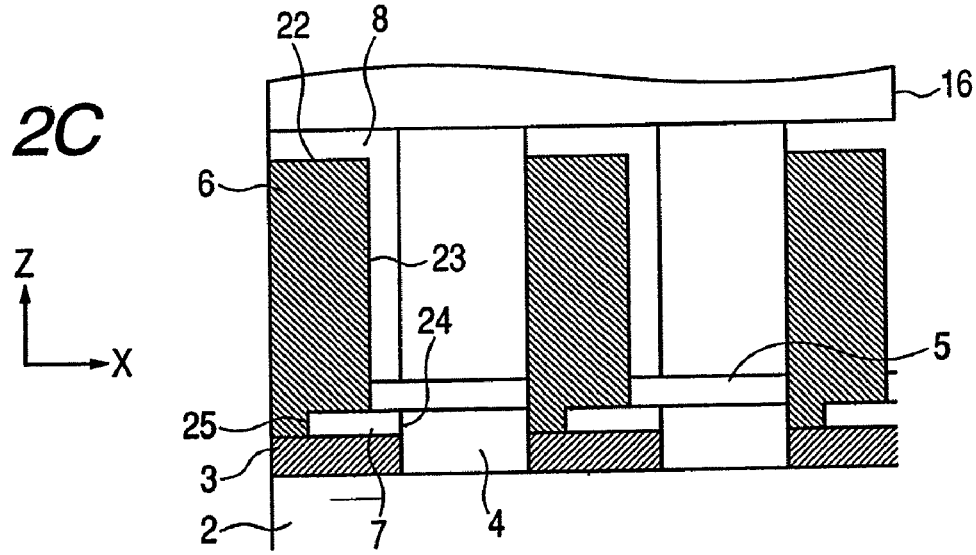

FIGS. 2A, 2B and 2C are detailed diagrams illustrating the face plate of the image displaying apparatus illustrated in FIG. 1. More specifically, FIG. 2A is the internal diagram of the face plate, FIG. 2B is the cross section diagram along the line 2B-2B in FIG. 2A, and FIG. 2C is the partial enlarged diagram of FIG. 2B. In the following, the constitution of the face plate will be described with reference to FIGS. 2A, 2B and 2C.

The face plate 1 has a substrate 2. It is preferable to use a glass substrate for the substrate 2 especially in a point that the vacuum performance is maintained and the intensity is ensured.

A black member 3 is provided on the substrate 2. The black member 3, which has apertures, is formed in a lattice-like shape. Light-emitting members 4 consisted of phosphors are formed on the apertures. In the present embodiment, the light-emitting members 4 are color-coded by R (Red), G (Green) and B (Blue) so as to cope with color displaying. The color-coding pattern can be arbitrarily determined in accordance with display characteristics and that pattern is not limited specifically. As a result, the plural light-emitting members 4, which are provided oppositely to the plural surface conduction electron-emitting devices 13 are arranged and formed in matrix on the substrate 2.

Moreover, plural metal backs 5, each of which covers at least one light-emitting member 4 and which are mutually arranged in matrix at gaps, are provided on the substrate 2. Here, in order to suppress a discharging current flowing in the unlikely event of a discharge, the metal backs 5 are divided for each aperture, namely, each sub pixel (e.g., R in RGB). The metal backs 5 can be patterned through masking or etching, by means of a known film forming method. In particular, it is preferable to form the metal backs 5 through mask vapor deposition because it is simple. Although the metal backs 5 are divided like lattices, the partial metal backs 5 which are adjacent to each other may be continuously formed.

Moreover, ribs 6, which extend toward a certain direction among the plural light-emitting members 4 and are used to suppress halation, are provided on the substrate 2. The ribs 6 include first striped portions 61 which are positioned among the plural light-emitting members 4 and protrude toward the rear plate 9 (i.e., in the Z direction). Incidentally, it should be noted that, in the following description, the first striped portion 61 is the generic term which implies the plural protrusions extending in the Y direction. The rib 6 supports the spacer 16 through a later-described spacer connection wiring 8 on its top surface 22. More specifically, the rib 6 is provided on the edge of the black member 3 extending in the Y direction, namely, between the divided adjacent metal backs 5. Here, the height of the rib 6 is suitably selected based on a pixel size, an anode voltage and the like. Further, the ribs 6 can be formed by a known manufacturing method such as a laminating manufacturing method of laminating pattern prints, a blast manufacturing method for a thick film, a slit coating manufacturing method, or the like. In particular, it is preferable to manufacture the ribs 6 by the blast manufacturing method in terms of productivity, accuracy, and large screen application.

Moreover, resistive wirings (feeding wirings) 7, which supply anode potential to the metal backs 5 and electrically connect the plural metal backs 5 mutually, are provided on the substrate 2. The resistive wiring 7 is positioned between the substrate 2 and the rib 6, and extends in the Y direction between the rib 6 and the black member 3. Further, the resistive wiring 7 is made by a resistor for suppressing a discharging current flowing in the unlikely event of a discharge. The resistive wiring 7 is provided for each column of the metal backs 5, and only an edge portion 24 of one side of the resistive wiring 7 is exposed from the rib 6 in the Y direction along which the resistive wiring 7 extends. Thus, the resistive wiring 7 is electrically connected to the adjacent metal back 5 through the exposed edge portion 24. However, an edge portion 25 of the other side is not exposed from the rib 6, and the edge portion 25 is not connected to the adjacent metal back 5. That is, since only one side of the adjacent metal back 5 is connected to the resistive wiring 7, it is possible to suppress a short circuit between the adjacent metal backs 5 even if a discharge occurs as an unlikely event, whereby a discharging current suppressing capability can be maintained. In any case, the resistive wirings 7 can be formed by a known manufacturing method such as a pattern printing method, a dispenser method, or the like. In particular, it is preferable to manufacture the resistive wirings 7 by the pattern printing method in terms of accuracy and productivity.

The spacer connection wiring 8, which extends from the resistive wiring 7 onto the top surface 22 of the rib 6 through the metal back 5, is formed on a side wall 23 of the rib 6. The spacer connection wiring 8 rises up to the top surface 22 in the direction (Z direction) perpendicular to the substrate 2 on the side wall 23 of the rib 6, and further extends in the direction (Y direction) along which the rib 6 extends on the top surface 22 up to the position abutting against the spacer 16. More specifically, as illustrated in FIG. 2A, the spacer connection wiring 8 extends up to the portion between the metal backs adjacent in the Y direction, whereby the spacer is arranged at this portion (that is, the portion between the metal backs adjacent in the Y direction). As a result, the spacer 16 is directly connected to the spacer connection wiring 8 on the rib 6, and the resistive wiring 7 and the spacer 16 are electrically connected to each other on the top surface 22 of the rib 6 through the spacer connection wiring 8. As just described, the rib 6 has on its surface the spacer connection wiring 8 which abuts against the spacer 16, and the spacer connection wiring 8 further abuts against the resistive wiring 7. Thus, the spacer connection wiring 8 and the resistive wiring 7 are electrically connected to each other. Consequently, it is possible to regulate the spacer 16 to have desired potential. In any case, the spacer connection wirings 8 can be patterned through masking or etching, by means of a known film forming method. In particular, it is preferable to pattern the spacer connection wirings 8 through mask vapor deposition because it is simple.

The spacer connection wiring 8 is formed only on the side wall 23 of one side of each rib 6 in regard to the direction (Y direction) through which the rib 6 extends. Thus, since secondary discharge (that is, discharge between the metal backs adjacent in the X direction) in the substrate 2 can be suppressed in case of the discharge occurring, a desired discharging current suppressing capability can be achieved. That is, by providing the spacer connection wiring 8 only on the side wall 23 of one side of the rib 6, a creepage distance from the adjacent metal back 5 can be attained. Consequently, in the unlikely event that the discharge occurs, since the short circuit between the adjacent metal backs 5 can be suppressed, the discharging current suppressing capability can be maintained.

Preferably, the spacer connection wirings 8 and the metal backs 5 are formed integrally. In this case, since the metal backs 5 and the spacer connection wirings 8 can be simultaneously formed only by pattern-forming the metal backs 5, productivity improves.

When referring to FIG. 1, the metal back 5 is electrically connected to a terminal Hv of the vacuum envelope 15, and a high voltage of about 1 kV to 15 kV is applied by a not-illustrated high voltage power supply. The scanning wirings 11 and the signal wirings 12 are respectively connected to terminals Dyn (n denotes positive integers 1 to N) and terminals Dxm (m denotes positive integers 1 to M) of the vacuum envelope 15, and scanning signals and image signals are respectively given to the scanning wirings 11 and the signal wirings 12 by a not-illustrated driver circuit. The surface conduction electron-emitting devices 13 emit electrons according to the signals, and the electrons attracted by the metal back potential pass through the metal backs 5 and thus cause the phosphors of the light-emitting members 4 to emit light. The luminance can be adjusted according to the voltage or the signals.

When the image displaying apparatus 21 operates, there is a possibility that so-called halation occurs because some of the electrons are diffused and reflected and further some of the diffused and reflected electrons cause the phosphors to again emit light. However, in the image displaying apparatus 21 according to the present embodiment, since the diffusion and the reflection of the electrons and the reentering of the electrons into the phosphors can be suppressed by means of the ribs 6, the halation can be effectively suppressed. Further, since the metal backs 5 are divided two-dimensionally, the image displaying apparatus which has an excellent withstand discharge function can be provided. Furthermore, since the side wall 23 of the rib 6 is used as the space for the wirings, the potential regulating for the spacer 16 can be performed only by providing a simple branch constitution (that is, the spacer connection wiring 8) from the resistive wiring 7.

In general, it is conceivable that an independent dedicated resistive line (feeding line) is provided to perform the potential regulating for the spacer 16. However, if doing so, the lines which are connected to the anode power supply at low resistance increase within the screen. This is not preferable from the aspect of suppressing of a discharging current. Further, it is conceivable that a through hole is formed inside the rib 6 to perform the potential regulating for the top surface 22 of the rib 6. However, since the rib 6 is an insulative member, withstand voltage is necessary between the adjacent metal backs 5. For this reason, if the low-resistance resistive portion is provided inside the rib 6, it is not preferable because there is a possibility that dielectric breakdown occurs. Thus, as indicated in the present embodiment, it is preferable to provide the spacer connection wiring 8 by using the side wall of the rib.

Incidentally, in the present embodiment, the resistive wirings and the spacer connection wirings are arranged regularly in regard to all of the metal backs. Consequently, since the potential distribution can be made substantially even within the image region, displaying characteristics can be made uniform.

Second Embodiment

Figure 3A:
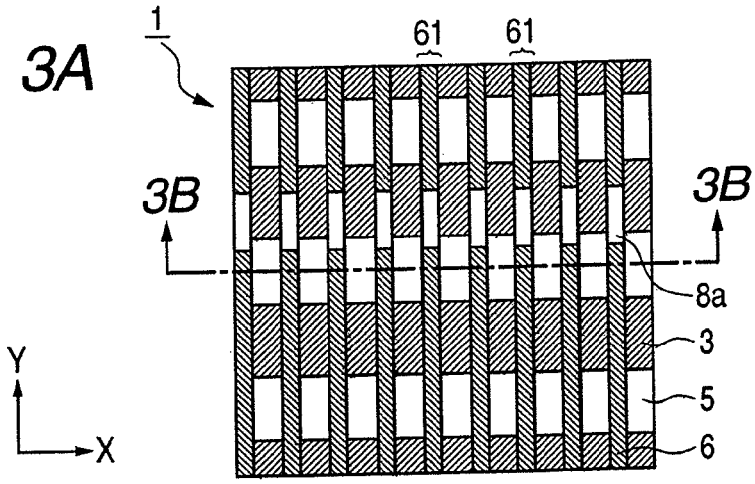
FIGS. 3A, 3B and 3C are detailed diagrams illustrating a face plate of an image displaying apparatus according to the second embodiment of the present invention.
Figure 3B:
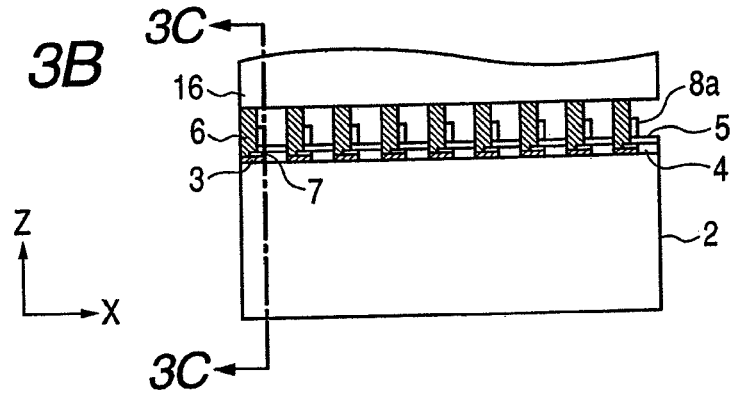
Figure 3C:
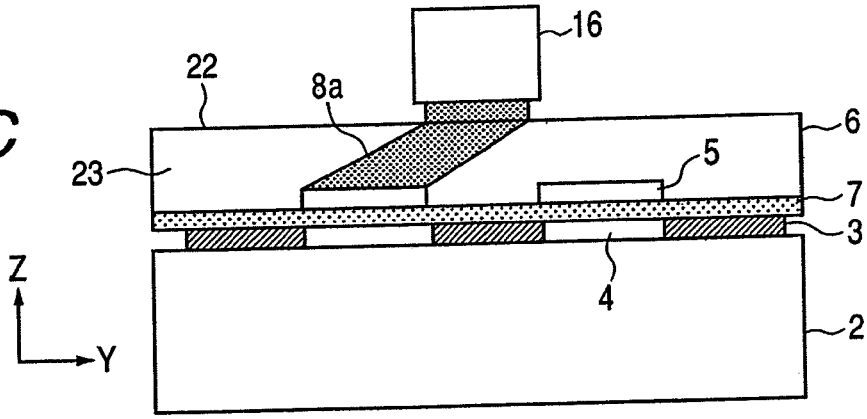

The present embodiment is substantially the same as the first embodiment except for routing of spacer connection wirings. FIGS. 3A, 3B and 3C are detailed diagrams illustrating a face plate of an image displaying apparatus according to the second embodiment. More specifically, FIG. 3A is the internal diagram of the face plate, FIG. 3B is the cross section diagram along the line 3B-3B in FIG. 3A, and FIG. 3C is the cross section diagram along the line 3C-3C in FIG. 3B. In the present embodiment, an abutment of a spacer connection wiring 8*a* which abuts against a spacer 16 and an abutment of the spacer connection wiring 8*a* which abuts against a resistive wiring (feeding wiring) 7 are respectively positioned so that they are out of alignment in the direction (Y direction) along which a first striped portion extends. That is, the spacer connection wiring 8*a* extends at the shortest distance between a metal back 5 and a portion of a rib 6 abutting against the spacer 16.

Third Embodiment

Figure 4A:
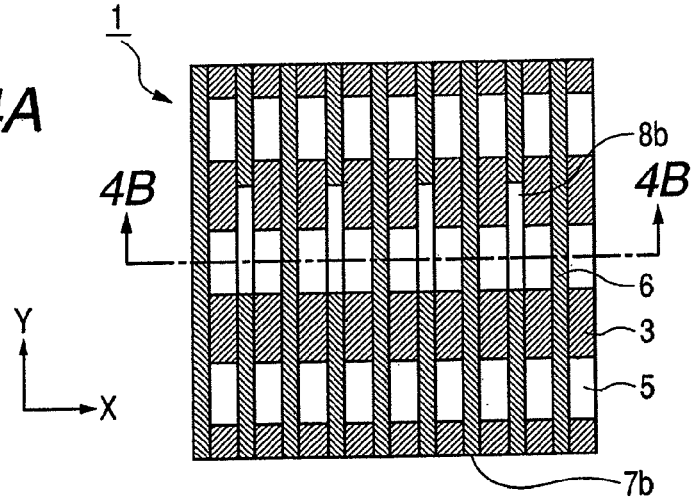
FIGS. 4A, 4B and 4C are detailed diagrams illustrating a face plate of an image displaying apparatus according to the third embodiment of the present invention.
Figure 4B:
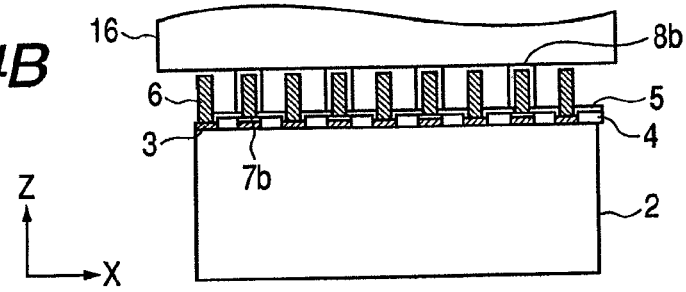
Figure 4C:
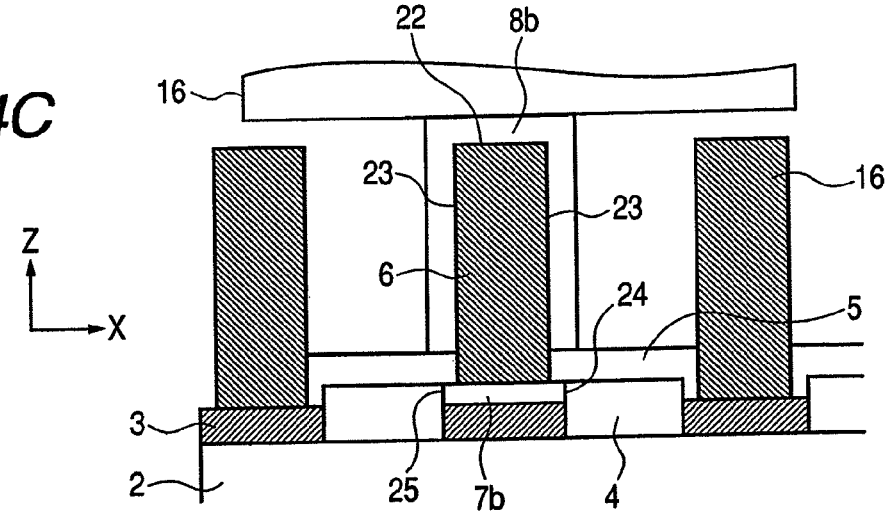

The present embodiment is characterized in that resistive wirings are regularly thinned out. FIGS. 4A, 4B and 4C are detailed diagrams illustrating a face plate of an image displaying apparatus according to the third embodiment. More specifically, FIG. 4A is the internal diagram of the face plate, FIG. 4B is the cross section diagram along the line 4B-4B in FIG. 4A, and FIG. 4C is the partial enlarged diagram of FIG. 4B. In the present embodiment, plural ribs 6 are provided, and spacer connection wirings 8*b* are formed alternately with the ribs 6. More specifically, the spacer connection wiring 8*b* is formed on both side walls 23 of the alternate rib 6 in the direction (Y direction) along which the rib 6 extends. Further, a resistive wiring (feeding wiring) 7*b* is provided only between the rib 6 on which the spacer connection wiring 8*b* has been formed and a substrate 2 (FIG. 4C). Both edge portions 24 and 25 of the resistive wiring 7*b* are exposed from the rib 6 in the direction (Y direction) along which the resistive wiring 7*b* extends, and the resistive wiring 7*b* is electrically connected to adjacent metal backs 5 at both sides through the exposed edge portions 24 and 25. Thus, the resistive wiring 7*b* is provided every plural columns of the metal backs 5. As a result, since the both-side metal backs 5 are electrically connected to each other by means of the resistive wiring 7*b* and the spacer connection wiring 8*b*, one anode region is formed. When a discharge occurs, a potential difference occurs between the adjacent metal backs 5. However, since the resistive wirings are thinned out, it is unnecessary to arrange the resistive wiring to the rib 6 at the dividing portion of the metal backs, whereby a secondary discharge can be suppressed. That is, the present embodiment can provide an effective means for maintaining desired withstand discharge performance according to an anode voltage or a pixel size.

Fourth Embodiment

Figure 5A:
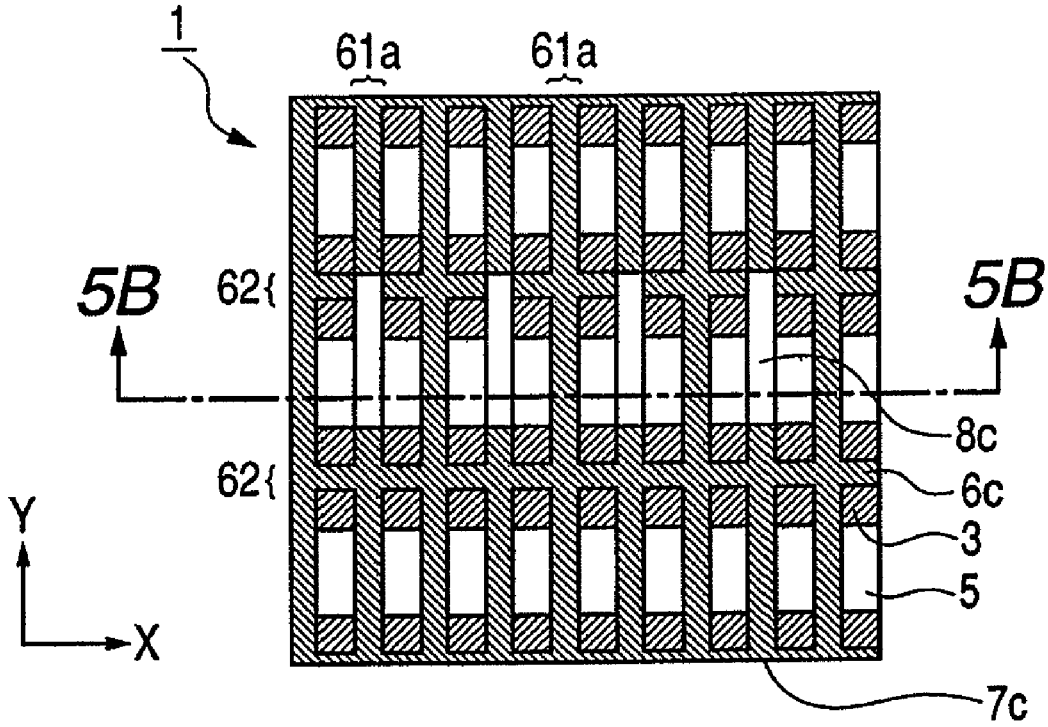
FIGS. 5A and 5B are detailed diagrams illustrating a face plate of an image displaying apparatus according to the fourth embodiment of the present invention.
Figure 5B:
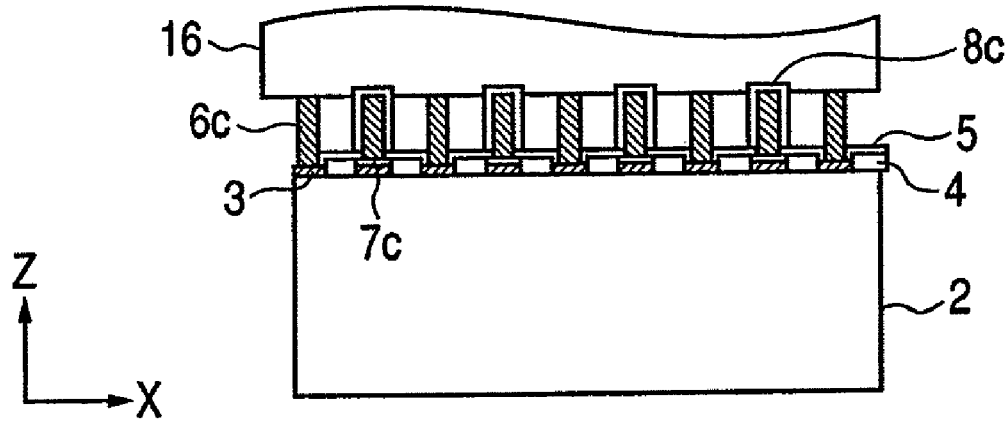

The present embodiment is substantially the same as the third embodiment except for ribs which are latticed. FIGS. 5A and 5B are detailed diagrams illustrating a face plate of an image displaying apparatus according to the fourth embodiment. More specifically, FIG. 5A is the internal diagram of the face plate, and FIG. 5B is the cross section diagram along the line 5B-5B in FIG. 5A. In the present embodiment, ribs 6*c* have a lattice shape which includes first striped portions 61*a* and second striped portions 62 extending in the direction perpendicular to the first striped portions 61*a*. Consequently, it is preferable because halation can be suppressed two-dimensionally. Incidentally, it should be noted that the present embodiment is applicable not only to the third embodiment but also to the first and second embodiments in which the resistive wiring is provided for each column.

Example 1

This example is an example of the image displaying apparatus illustrated in FIGS. 1, 2A, 2B and 2C. The face plate of the image displaying apparatus in this example was manufactured as described below. That is, a lattice-like shape, which has apertures only on desired regions of the light-emitting members, was screen-printed on a surface of a cleaned glass substrate by using a black paste (NP-7803D available from Noritake Co., Ltd.), and the obtained glass substrate was baked at 550° C. after drying it at 120° C., thereby forming the black member 3 of which the thickness is 5 μm. Here, pitches of the aperture portion were set to 450 μm in the Y direction and 150 μm in the X direction, as well as device pitches on the rear plate, and the sizes of the aperture portion were set to 220 μm in the Y direction and 90 μm in the X direction.

Next, a high-resistance paste containing ruthenium oxide was formed, as the striped resistive wirings 7, on the pattern extending in the Y direction of the black member 3 by a screen printing method to have the film thickness 10 μm after the baking. Then, the obtained high-resistance paste was dried at 120° C. for 10 minutes. In this example, the width of the resistive wiring 7 was set to 40 μm, and the one-side position of the wiring was aligned with the black member 3 of which the width is 60 μm so as to expose the black member of the width 20 μm. Then, the material used in such a high-resistance layer was applied to a test pattern and the resistance thereof was measured. The obtained volume resistance of this material was about $10^{-1}$ Ω·m.

Next, a bismuth oxide insulative paste (NP7753 available from Noritake Co., Ltd.) finally constituting the rib structure was applied by a slit-coater and baked at 120° C. for 10 minutes so as to have the film thickness 200 μm after the baking.

Next, a DFR (dry film resist) was pasted by using a laminator apparatus. Further, a chrome mask to be used for exposure was aligned to a predetermined position and then the DFR was pattern exposed. Such alignment was performed by using a not-illustrated alignment mark provided outside the image formation region. The exposing pattern was set to the striped shape of the width 50 μm (therefore, the width of the aperture portion is 100 μm) so as to overlap the black member 3, in parallel with the longitudinal edge of the aperture of the black member 3 (that is, extending in the Y direction). At this time, the resistive wiring 7 was aligned with the aperture edge on the exposing side from the resistive wiring 7 so that the resistive wiring 7 was exposed by 10 μm in regard to the width 60 μm of the black member 3. Further, exposure of the DFR, developing, a showering process of rinse liquid and drying are performed, whereby a mask for sand blasting, having apertures on desired positions, was formed. Next, the unnecessary high-resistance paste and the unnecessary insulative paste were eliminated in conformity with the apertures of the DFR by a sand blasting method in which SUS (Stainless Used Steel) grains were used as grinding grains. After then, the DFR was stripped off by a remover liquid shower, and the wirings were cleaned. Next, the wirings were baked at 530° C., whereby the resistive wirings 7 having the ribs 6 and the resistors were formed.

Next, a phosphor was dropped into the light-emitting members and printed by a screen printing method in conformity with the rib structure having the striped apertures by using a paste in which phosphors P22 typically used in the technical field of CRTs (cathode ray tubes) were dispersed. In this example, the phosphors of three colors R, G and B were separately striped and coated so as to form a color display. Here, the thickness of each phosphor was set to 15 μm. The three-color phosphors were dried at 120° C. after the printing. Incidentally, the drying may be performed for each color or for all of three colors in a lump. Further, a solution containing silicate alkali, so called a liquid glass, acting as a binding agent was applied.

Next, an acrylic emulsion was applied and dried by the spray coating method, and the spaces in powder phosphors were infilled by acrylic resin. Then, an aluminum film acting as the metal back 5 was vapor deposited. At this time, the metal backs 5 were formed only to the light-emitting members by using a metal mask having the apertures only at the portions corresponding to the respective light-emitting members. Here, the thickness of the aluminum film was set to 100 nm. After then, the acrylic resin layer was decomposed and eliminated by baking it at 450° C.

Finally, the spacer connection wirings 8 were formed by vapor depositing the aluminum film obliquely from one direction with use of the metal mask which was striped in the X direction in conformity with the apertures and to be divided in the Y direction. Incidentally, the spacer connection wirings 8 may be made not only of aluminum but also of titanium, chrome or the like.

Incidentally, high-voltage induction terminals penetrating the face plate 1 were provided in the face plate 1 via through holes, and the high-voltage induction terminals were connected at the edge portion of the image formation region with the resistive wirings 7 (not illustrated).

By using the face plate 1 manufactured as described above, the image displaying apparatus illustrated in FIG. 1 was manufactured by properly combining the rear plate 9, the outer frame 14 and the conductive spacers 16. At this time, sufficient alignment was performed so that the conductive spacers 16 abut exactly against the spacer connection wirings 8. Then, an image was displayed by applying voltage of 8 kV to the metal backs 5 through the resistive wirings 7. In this case, the excellent image in which color mixture due to halation is low could be displayed. Further, since the potential of the spacers was regulated, image distortion based on deviation of the electron beams was not confirmed even in the vicinity of the spacer, whereby an excellent image could be displayed.

Besides, device breakdown was caused by applying excessive voltage to a specific device so that a discharge was induced between the metal backs 5 and the face plate 1. However, even in such a case, since the discharging current was sufficiently limited, any abnormality did not occur in the peripheral devices other than the deliberately broken device.

Example 2

This example corresponds to the second embodiment illustrated in FIGS. 3A to 3C. This example is different from Example 1 in the point concerning a forming pattern of the spacer connection wirings 8. That is, in this example, the spacer connection wiring 8 extends obliquely toward the connecting position with the spacer on the side wall of the rib 6.

The spacer connection wirings 8 can be formed simultaneously with the metal backs 5. The spacer connection wirings 8 are obtained by performing vapor deposition obliquely in both the X direction and the Y direction by using the metal mask covering the portions other than the necessary portions on the upper surface of the ribs.

As well as Example 1, the image displaying apparatus was manufactured by using the face plate 1 thus manufactured, and an image was displayed thereon by applying voltage of 8 kV to the metal backs 5 through the resistive wirings 7. In this case, the excellent image in which color mixture due to halation is low could be displayed. Further, since the potential of the spacers was regulated, image distortion based on deviation of the electron beams was not confirmed even in the vicinity of the spacer, whereby an excellent image could be displayed.

Besides, device breakdown was caused by raising the voltage of the metal backs 5 to 8 kV and applying excessive voltage to a specific device so that a discharge was induced between the metal backs 5 and the face plate 1. However, even in such a case, any secondary discharge did not occur. Further, since the discharging current was sufficiently limited, any abnormality did not occur in the peripheral devices other than the deliberately broken device.

Example 3

This example corresponds to the third embodiment illustrated in FIGS. 4A to 4C. This example is difference from Example 1 in the point that two phosphors adjacent in the X direction are set as one anode region, and the single resistive wiring 7*b* is arranged between the two phosphors, for one anode region. The width of the resistive wiring 7*b* was set to 60 μm, the width of the rib 6 was set to 50 μm, and the centers of the resistive wiring 7*b*, the rib 6 and the black member 3 were set to be aligned. Further, the spacer connection wiring 8*b* was provided on both the side walls of the rib abutting against the resistive wiring 7*b*. Here, the spacer connection wiring 8*b* was formed by obliquely vapor depositing the aluminum film sequentially one by one in the relative two directions, by using the mask covering the portions other than the necessary portions.

As well as Example 1, the image displaying apparatus was manufactured by using the face plate 1 thus manufactured, and an image was displayed thereon by applying voltage of 8 kV to the metal backs 5 through the resistive wirings 7*b*. In this case, the excellent image in which color mixture due to halation is low could be displayed. Further, since the potential of the spacers was regulated, image distortion based on deviation of the electron beams was not confirmed even in the vicinity of the spacer, whereby an excellent image could be displayed.

Besides, device breakdown was caused by raising the voltage of the metal backs 5 to 10 kV and applying excessive voltage to a specific device so that a discharge was induced between the metal backs 5 and the face plate 1. However, even in such a case, any secondary discharge did not occur. Further, since the discharging current was sufficiently limited, any abnormality did not occur in the peripheral devices other than the deliberately broken device.

Example 4

This example corresponds to the fourth embodiment illustrated in FIGS. 5A and 5B. This example is difference from Example 1 in the point that the ribs 6*c* were set to have the lattice formation also extending in the X direction. The height of the rib 6*c* was set to 150 μm.

As well as Example 1, the image displaying apparatus was manufactured by using the face plate 1 thus manufactured, and an image was displayed thereon by applying voltage of 8 kV to the metal backs 5 through the resistive wirings 7*c*. In this case, the excellent image in which color mixture due to halation is low could be displayed. Further, the lines in the X direction could be clearly displayed as compared with Example 1. Furthermore, since the potential of the spacers was regulated, image distortion based on deviation of the electron beams was not confirmed even in the vicinity of the spacer, whereby an excellent image could be displayed.

Besides, device breakdown was caused by applying excessive voltage to a specific device so that a discharge was induced between the metal backs 5 and the face plate 1. However, even in such a case, since the discharging current was sufficiently limited, any abnormality did not occur in the peripheral devices other than the deliberately broken device.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-175677, filed Jul. 4, 2008, which is hereby incorporated by reference herein in its entirety.

What is claimed is:

1. An image displaying apparatus comprising:

a rear plate that has plural electron-emitting devices arranged in matrix;

a face plate that has a substrate, plural light-emitting members arranged in matrix on the substrate, plural metal backs each of which covers at least the one light-emitting member and which are mutually arranged in matrix at gaps, ribs which have first striped portions respectively positioned among the plural light-emitting members and protruding toward the rear plate, and a resistive wiring which includes a resistor positioned between the substrate and the ribs and electrically connecting the plural metal backs to others, and that is positioned oppositely to the rear plate; and a spacer that is positioned between the rear plate and the ribs to mutually support the rear plate and the face plate, wherein the rib has, on its surface, a spacer connection wiring which abuts against the spacer, and wherein the spacer connection wiring is electrically connected to the resistive wiring.

2. An image displaying apparatus according to claim 1, wherein the spacer connection wiring abuts against the resistive wiring.

3. An image displaying apparatus according to claim 2, wherein a positioned abutment between the spacer connection wiring and the spacer is deviated from a positioned abutment between the spacer connection wiring and the resistive wiring in a direction along which the first striped portions extend.

4. An image displaying apparatus according to claim 2, wherein the resistive wiring is provided for each column of the metal backs.

5. An image displaying apparatus according to claim 2, wherein the resistive wiring is provided every plural columns of the metal backs.

6. An image displaying apparatus according to claim 1, wherein the ribs have a lattice shape which consists of the first striped portions and second striped portions extending in a direction perpendicular to the first striped portions.

7. An image displaying apparatus according to claim 1, wherein the spacer connection wiring and the metal back are integrally formed.

* * * * *